US005934641A

United States Patent [19]

Vince

[11] Patent Number: 5,934,641

[45] Date of Patent: Aug. 10, 1999

[54] COLLAPSIBLE NURSERY STAND

[76] Inventor: Andrew Paul Vince, 6 Sheppey Cottages, Neptune Terrace, Sheerness, Kent, United Kingdom, ME12 2AN

[21] Appl. No.: 08/836,919

[22] PCT Filed: Nov. 3, 1995

[86] PCT No.: PCT/GB95/02590

§ 371 Date: Apr. 30, 1997

§ 102(e) Date: Apr. 30, 1997

[87] PCT Pub. No.: WO96/14007

PCT Pub. Date: May 17, 1996

[30] Foreign Application Priority Data

Nov. 3, 1994 [GB] United Kingdom ..... 9422173

[51] Int. Cl.[6] ..... F16M 11/38

[52] U.S. Cl. ..... 248/431; 248/165; 248/434; 248/439

[58] Field of Search ..... 248/163.1, 164, 248/431, 432 K, 166, 434, 439, 165; 5/611; 211/132; 108/118

[56] References Cited

U.S. PATENT DOCUMENTS

| | | | |
|---|---|---|---|
| 1,336,302 | 4/1920 | Krey | 5/106 |
| 2,482,318 | 9/1949 | Carruth | 5/109 |
| 2,623,755 | 12/1952 | Terry | 248/439 |
| 3,839,754 | 10/1974 | Hooper | 248/164 |
| 4,377,011 | 3/1983 | Kinberger | 5/102 |
| 4,705,247 | 11/1987 | Delmerico | 248/98 |
| 5,199,930 | 4/1993 | Weber | 248/164 |
| 5,496,094 | 3/1996 | Schwartzkopf et al. | 248/164 |

FOREIGN PATENT DOCUMENTS

| | | |
|---|---|---|
| 1410283 | 6/1964 | France . |
| 622803 | 5/1949 | United Kingdom . |
| 657456 | 9/1951 | United Kingdom . |
| 733327 | 7/1955 | United Kingdom . |
| 1061089 | 3/1967 | United Kingdom . |
| 2214421 | 9/1989 | United Kingdom . |

*Primary Examiner*—Ramon O. Ramirez
*Assistant Examiner*—Gwendolyn Baxter
*Attorney, Agent, or Firm*—Biebel & French

[57] ABSTRACT

Collapsible nursery stand comprising a pair of scissor action side frames each comprising a pair of limbs (6, 8) from upper regions of which U-shaped link members depend which swingingly support a carry-cot (36) or the like. The link members may be interconnected by a frame (22) for holding the carry-cot (36). On each side of the stand a strut (50) extends between the limbs (6, 8) to hold the stand in an erected configuration so that the carry-cot (36) can swing on the links. Each strut includes a securing means which can be released to permit the stand to collapse. Lower ends of the links move towards each other as this occurs. The securing means may comprise a plate (49) with a track (54), a pair of telescoping members, a hooked bar, an over centre latch mechanism or a strut which is slidingly engageable with one limb member.

21 Claims, 8 Drawing Sheets

COLLAPSIBLE NURSERY STAND

The present invention relates to a collapsible stand suitable for supporting a carry-cot or Moses basket.

A typical prior art carry-cot stand is described in GB-A-2214421. This stand includes a pair of scissor action side frames each of which is provided with a two-part arm, the ends of which are pivotally connected to a different limb of one of the scissor action side frames. As the frame is opened, the two arms are reconfigured from a doubled up configuration to an extended configuration in which arm parts are substantially aligned. Place a carry-cot into an upper region of the stand urges upper portions of each side frame apart thus placing the arms in tension. Once the arms have reached a straight configuration, tension in the arms resists further opening of the side frames. One disadvantage is that this arrangement does not permit the carry-cot supported by the stand to be rocked.

Cots which permit rocking exist but they are not easily foldable into a substantially flat configuration so as to facilitate transportation and storage. Such cots are described in U.S. Pat. Nos. 2,482,318 and 1,336,302.

The object of the invention is to provide a stand suitable for supporting a carry-cot which both allows the carry-cot to be swung and allows the stand to be easily folded flat when not in use.

A further object of the invention is to provide a carry-cot stand which does not require disengagement of any of its parts prior to being folded flat.

Thus according to the invention there is provided a collapsible nursery stand comprising a pair of interconnected scissor action side frames each comprising a pair of limbs and securing means which in a first state secures the stand in an erected configuration and in a second state permits the stand to be collapsed, characterised in that the stand further comprises link means which depend from upper regions of the limbs when the stand is erected for swingingly supporting infant accommodating means.

By providing links which can swing with respect to the limbs constituting the side frames, for supporting infant accommodating means, such links can easily be oriented towards alignment with the limbs when the stand is collapsed. Accordingly, such a stand can easily, without disengagement of any parts from the stand, be reconfigured between an erected and a collapsed state.

In order to provide an easy swinging action the link means preferably depend substantially vertically when the stand is erected and standing on level ground.

The link means preferably rotate through an angle of at least 45° and more preferably through an angle of at least 60° as the stand is collapsed to a configuration in which side frame limbs lie substantially on closely adjacent approximately parallel planes.

So that depending portions of the link means connected to different limbs of each side frame can be interconnected (for example by a frame or platform) while permitting collapsing of the frame without disassembly being necessary, preferably upper regions of the limbs of each side frame move away from each other as the stand collapses.

So as to reduce the number of parts comprised in the stand and so as to increase its rigidity the pair of scissor action side frames are preferably interconnected by two substantially U-shaped link members. For the same reasons the scissor action side frame preferably comprise a pair of substantially U-shaped frame members with pivotally interconnected limbs.

When the link means comprises a pair of U-shaped link members the stand preferably includes spacer means for supporting the infant accommodating means clear of a base portion of each link member in order to reduce frictional forces tending to damp any swinging action of the link means.

Preferably the stand includes a structure interconnecting the link means associated with the upper regions of the limbs of each side frame. Such a structure will increase the rigidity of the stand, facilitate automatic rotation of the link means as the stand is collapsed and can also be conveniently provided in the form of a frame for restraining movement of a typical infant accommodating means, such as a carry-cot, with respect to the link means. In order for the structure to restrain such movement effectively it preferably has raised ends.

Preferably the structure is adjustable in length in order to cater for different sized infant accommodating means and variable fixing means are provided for variation of the location at which at least one link of the link means is secured to the structure. With such an arrangement, depending portions of the link means can be arranged to depend substantially vertically regardless of the length of infant accommodating means being supported.

In order to increase the stability of the stand when erected preferably each first and second limb of one side frame is connected to a first and second limb respectively of the other side frame by a cross-member. Conveniently, each cross-member may engage the ground when the stand is in use and interconnect two limbs on opposite sides of the stand, thus forming a U-shape. In this way the side frames can comprise two hingeably interconnected U-shaped structures each formed in one piece from a tube or bar.

In order to still further increase the rigidity of the stand when it is erected the securing means preferably comprises a securing means associated with each side frame. By providing two independent securing means the safety of the stand will be increased because if one securing means is accidentally released the stand will remain supported by the other.

As there will normally be a load tending to collapse the stand when there is a requirement to secure it in its erected configuration the securing means may conveniently be provided by an over-centre latch mechanism. An elegantly simple form of over-centre latch mechanism may be provided by two pivotally interconnected latch members each of which is pivotally connected to a different limb of one side frame. To reduce the chance of such an over-centre latch mechanism being accidentally unlatched one of the latch members is preferably angled.

Conveniently the securing means comprises a strut interconnecting the limbs of one side frame and in order to avoid the necessity of disengaging one end of the strut from the frame to allow it to collapse, preferably the strut is connected to a first one of the limbs by a pivot and to a second one of the limbs of the side frame by a sliding arrangement. Such an arrangement will allow the struts to remain connected to both first and second limbs throughout collapsing of the stand.

One sliding arrangement which is particularly straightforward to manufacture and use is one which comprises a slider connected to the second limb which engages a track-way connected to the strut. By configuring the track-way so that it includes substantially straight shorter and longer track sections interconnected by a cross-track section, disengagement of the securing means to allow the stand to collapse or engagement of the securing means upon erection of the stand to the required height can be easily provided.

Alternatively the sliding arrangement may comprise a carriage connected to the strut which is displaceable along The second limb and a locking device for preventing such displacement when the stand is erected.

So that the strut may be pivoted to a fixed point on each limb the strut may be adjustable in length.

An even simpler securing means, which does require one end of the strut to be disconnected from its associated limb, is one including a strut pivotably connected to one limb and selectively engageable with the other limb of the side frame.

The invention also provides a collapsible stand as described above in combination with an infant accommodating means such as a carry-cot or so-called Moses basket. As an alternative to providing a carry-cot which can be lifted on and off the support frame the links may be connected directly to a crib which may itself be collapsible.

The invention will now be described by way of example only with reference to the following drawings in which.

Figure 1:
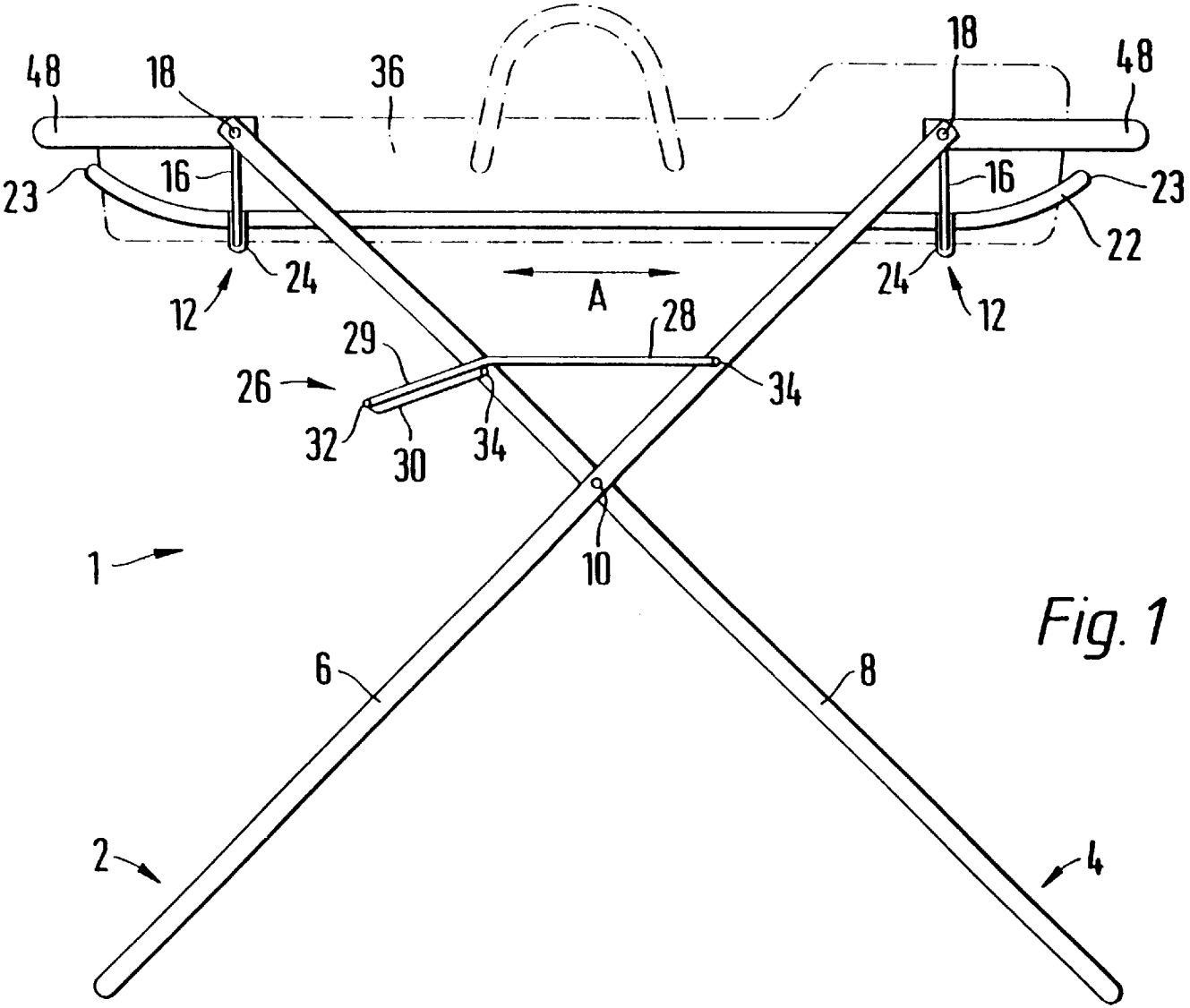
FIG. 1 is a side elevation of a stand according to the invention in an erected configuration.

The stand shown in FIGS. 1 to 6 includes two U-shaped frame members 2 and 4, each of which includes a pair of spaced substantially parallel limbs 6 and 8. Each limb 6 of the frame member 2 is pivotally connected to an adjacent limb 8 of the other frame member 4 by means of a bolt 10, rivet or some other suitable means which is positioned approximately centrally on its associated limbs 6 and 8. A pair of pivotally interconnected frame limbs 6 and 8 constitute a scissor action side frame.

Figure 3:
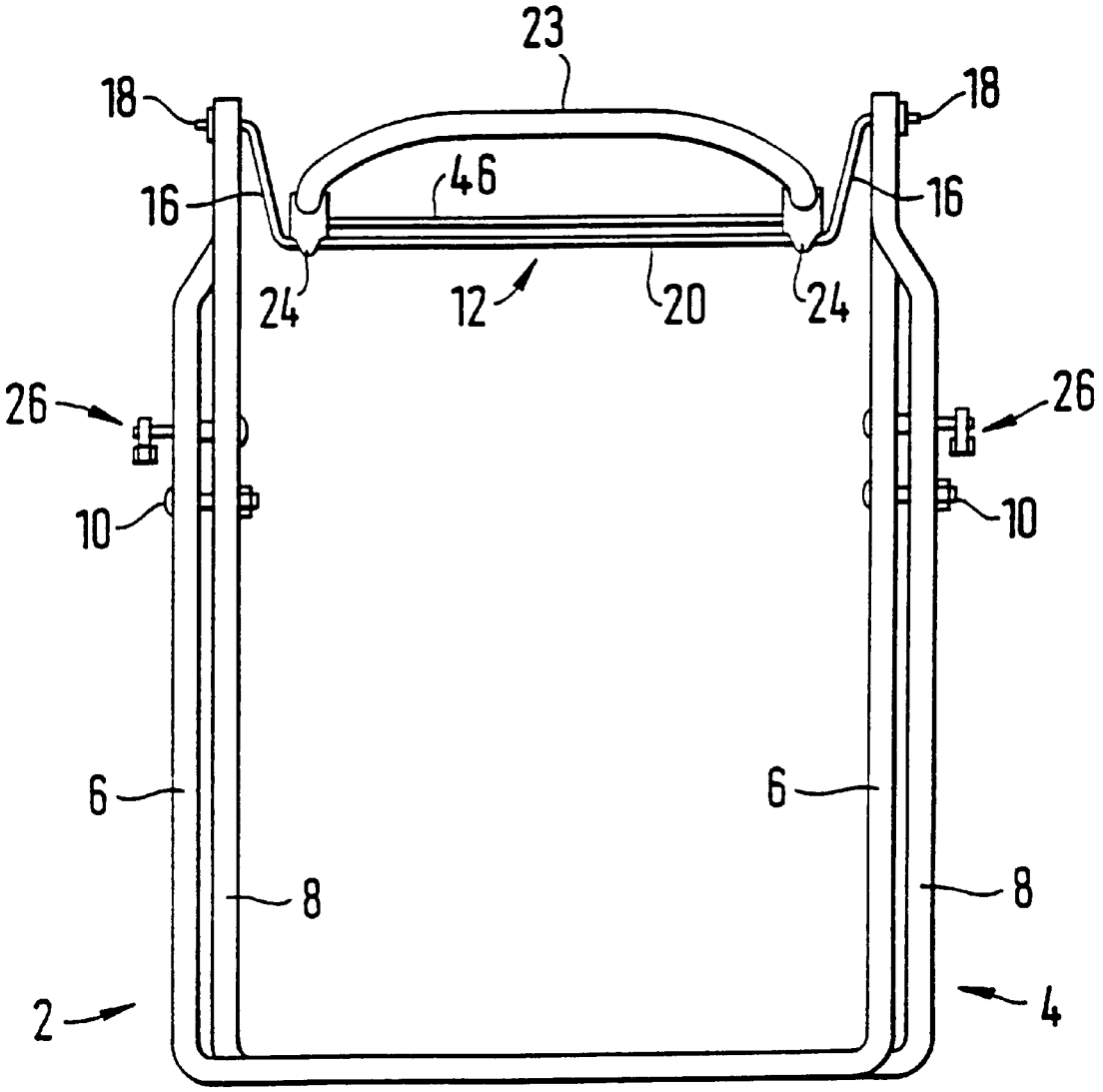
FIG. 3 is an end elevation of the stand shown in FIG. 1.
Figure 4:
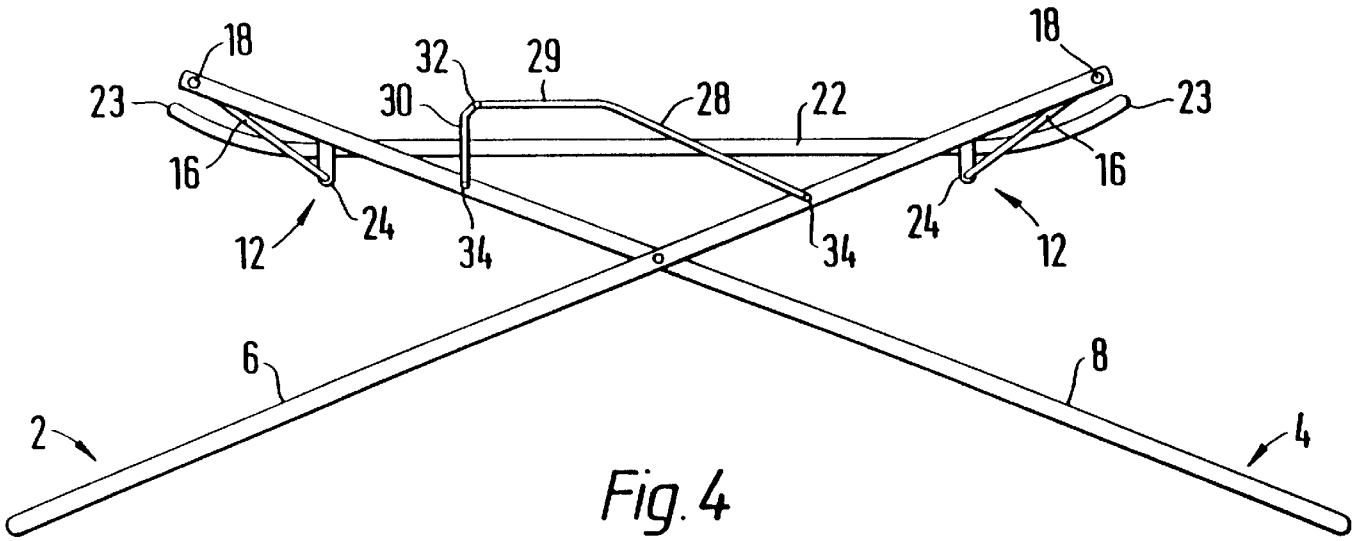
FIG. 4 is a side elevation of the stand shown in FIG. 1 in the process of being collapsed.
Figure 5:
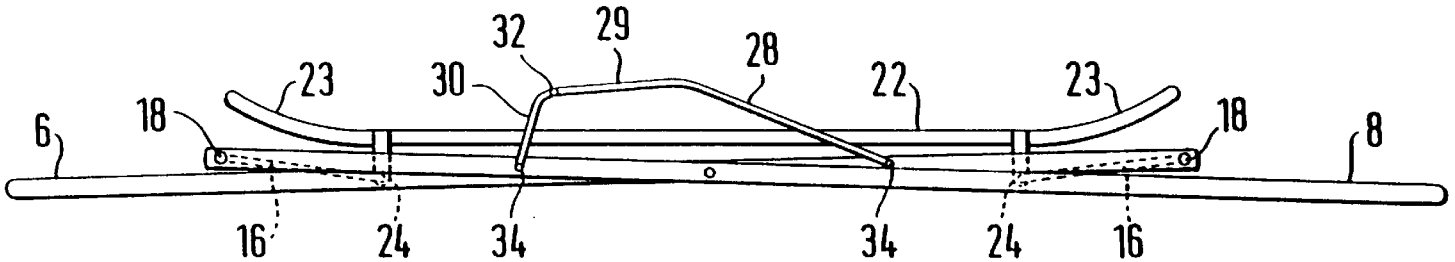
FIG. 5 is a side elevation of the stand in its collapsed configuration.
Figure 7:
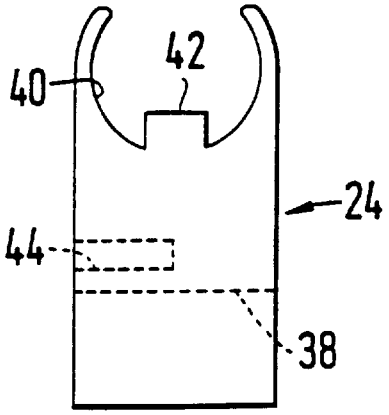
FIG. 7 is an end view of a clip used in the assembly of the stand.
Figure 8:
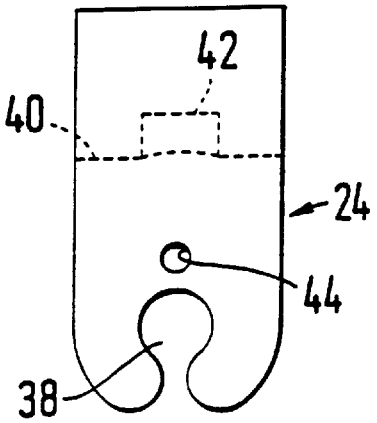
FIG. 8 is a side view of the clip shown in FIG. 7.

Distal ends of the limbs of each frame member 2 and 4 are interconnected by a shallow substantially U-shaped link member 12. Each link member 12 includes a central flat portion 20 with upstanding legs 16 at each end, the upper end of each of which is connected to an upper end of a side frame limb 6, 8 by an upper link pivot pin 18. When the frame is erected, the flat portions 20 of each link member 12 will be substantially horizontal and the upstand legs 16 will depend substantially vertically as seen in FIG. 1, and converge towards their lower ends as shown in FIG. 3. The flat portion 20 of each link member 12 is connected to a tubular substantially rectangular support frame 22 by means of two lower link pivot attachment clips 24 which are shown in detail in FIGS. 7 and 8. Each clip 24 includes a link recess 38 at its lower end which snap-fits over the flat portion of a link member 12, and a frame recess 40 at its upper end in which the support frame 22 snap-fits. A cylindrical lug 42 projects from an inner region of each frame recess 40 and snugly engages a complementary hole (not shown) in a lower surface of the support frame 22. This arrangement is particularly advantageous for holding the support frame 22 and the link members 12 in a fixed juxtaposition and makes accidental or intentional separation of the clips 24 from the support frame 22 very unlikely. Confronting faces of the clips 24 are provided with spacer recesses 44 which accommodate a spacer bar 46, as shown in FIG. 3. The purpose of the spacer bar 46 is to support the carry-cot 36 clear of the flat portions 20 of the link members 12, thus avoiding friction between an underside of the carry-cot and the link members impeding the swinging action of the link members 12.

Figure 2:
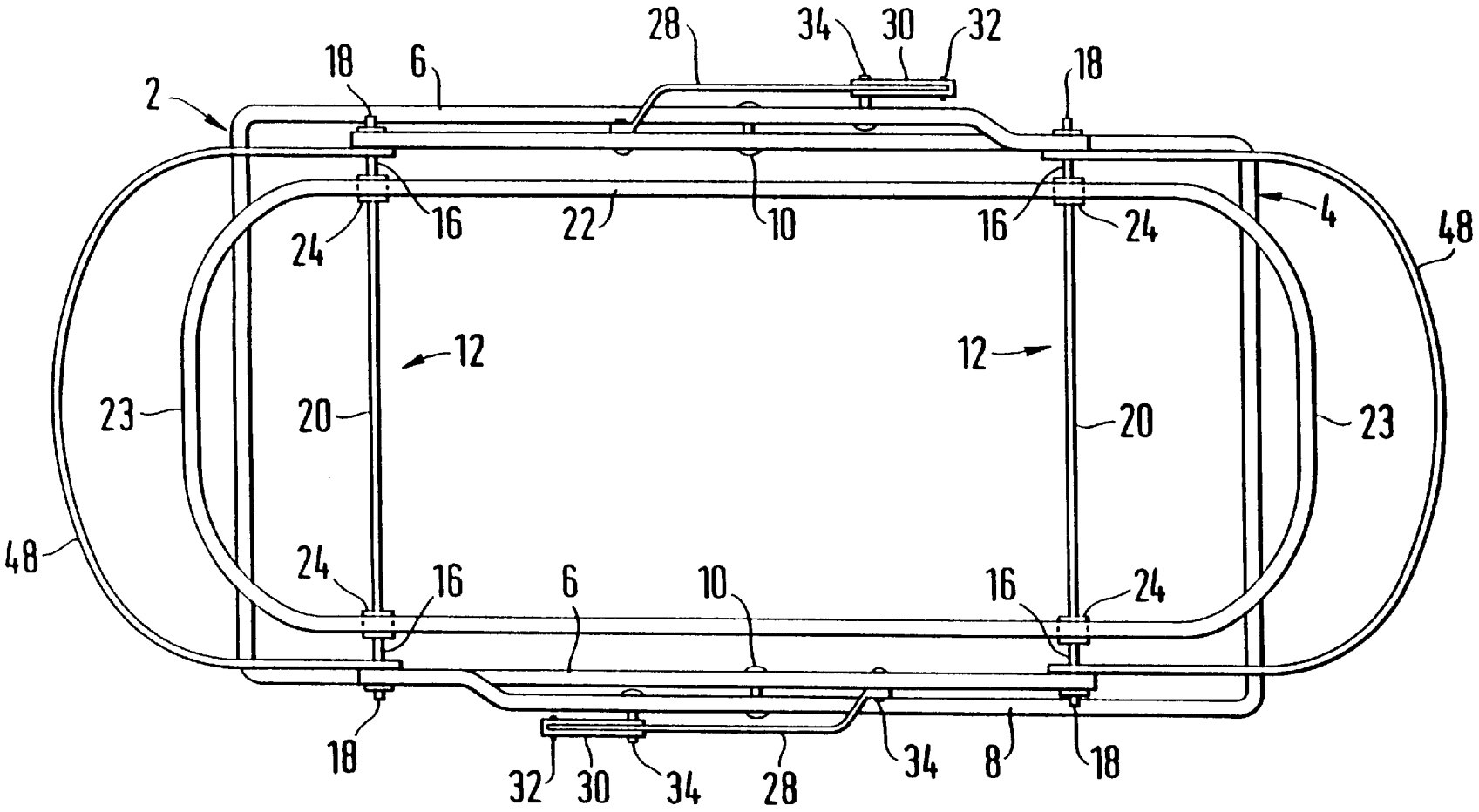
FIG. 2 is a top plan view of the stand shown in FIG. 1.
Figure 6:
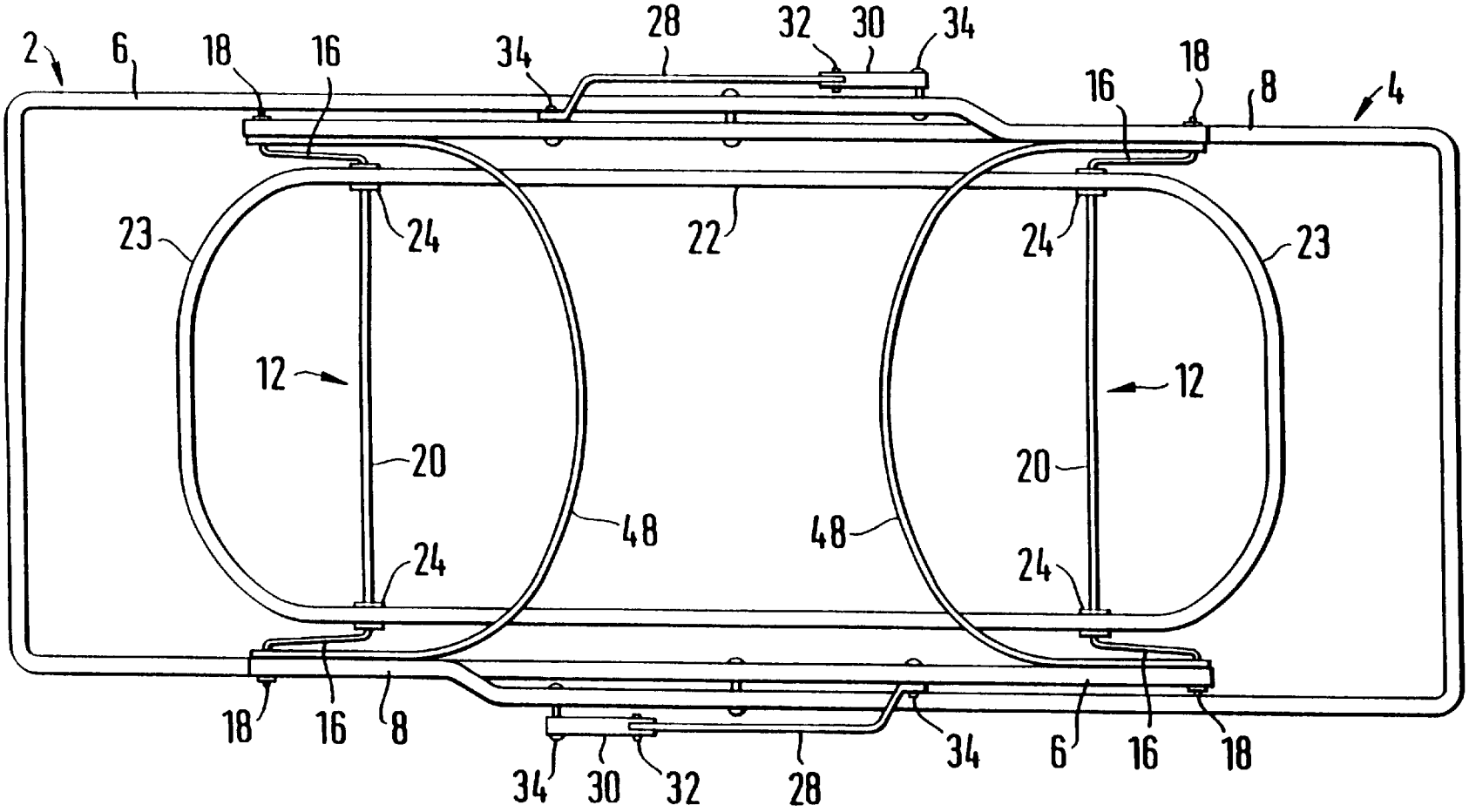
FIG. 6 is a top plan view of the stand shown in FIG. 5.

A substantially U-shaped guard 48 is rotatable about upper ends of the link upstand legs 16 at each end of the stand between a stowed position shown in FIG. 6 and a deployed position shown in FIGS. 1 and 2. The purpose of the guard is to limit the extent of swinging of the carry-cot and to prevent swinging of the carry-cot from being caused accidentally by a person knocking into the carry-cot for example. For the sake of simplicity the guards 48 have been omitted from the other views of the stand.

In the embodiment shown in FIGS. 1 to 6, each pair of interconnected side frame members 6 and 8 are provided with an over-centre latch mechanism 26 positioned a little way above the pivot bolt 10. Each latch mechanism 26 includes a longer angled arm 28 of circular cross-section and a shorter straight arm 30 which is channel shaped in cross-section. Adjacent ends of the arms 78 and 30 are pivotally interconnected by a pin 32 and the other ends of the longer and shorter arms are pivotably connected to side frame limbs 6 and 8 on one side of the stand respectively by bolts 34. A shorter section 29 of the angled arm 28 is approximately the same length as the straight arm 30 and is adapted to nest inside the channel section constituting the straight arm 30 when the stand is erected.

In use, the frame is configured as shown in FIGS. 1 to 3 with the side frame limbs 6 substantially perpendicular to the side frame limbs 8. The latch mechanism 26 on each side of the stand will be locked in place as described above and as shown in the drawings and a carry-cot 36 or Moses basket will be retained securely on the stand by being placed between raised end portions 23 of the support frame 22. The guards 48 will be rotated out to their extended positions. The link upstand legs 16 of the two link members 14 hold the support frame in such a manner that rocking of the carry-cot 36 in the direction of arrow A is possible.

When there is a requirement to collapse the stand the carry-cot 36 will be lifted off. The guards 48 will be rotated inwardly and the two latch mechanisms 26 will be released by upward pressure in the region of the two arm pivot pins 32. As the stand collapses towards the configuration shown in FIG. 4 the angle between the latch mechanism arms 28 and 30 of each latch mechanism will open up and the upper ends of the link upstand legs 16 will pivot outwardly about an axis defined by the flat portion 20 of the link members. The consequent separation of the upper ends of the link upstand legs 16 caters for separation of the upper link pivot pins 18 on each side of the stand which occurs as the stand collapses. Accordingly, without separating any stand components the stand can be collapsed to the configuration shown in FIGS. 5 and 6. It should be noted that once the latch mechanisms 26 have been released the stand collapses of its own accord under the action of gravity.

Rotation of each link upstand leg by approximately 75° as collapsing of the stand occurs obviates the necessity to disconnect the support frame 22 from one link member 12 or any other part of the stand. The combined length of the two link upstand legs 16 is selected to be substantially equal to the distance that the upper link pivot pins 18 on one side of the stand separate as the stand is collapsed from the erected configuration shown in FIG. 1 to the collapsed configuration shown in FIG. 5.

Erection of the stand is a straightforward reversal of the collapsing procedure described above. Lifting of the stand by means of the frame 22 results in the limbs 6 and 8 moving to the position shown in FIG. 1 at which point the over-centre latch mechanisms 26 will move automatically under the action of gravity towards the configuration shown in FIG. 1. Once this has occurred, by pressing the pins 32 of the over-centre latch mechanisms 26 downwardly, they will snap into the configuration shown in FIG. 1.

Various alternative latch mechanisms are shown in FIGS. 9 to 12.

Figure 9:
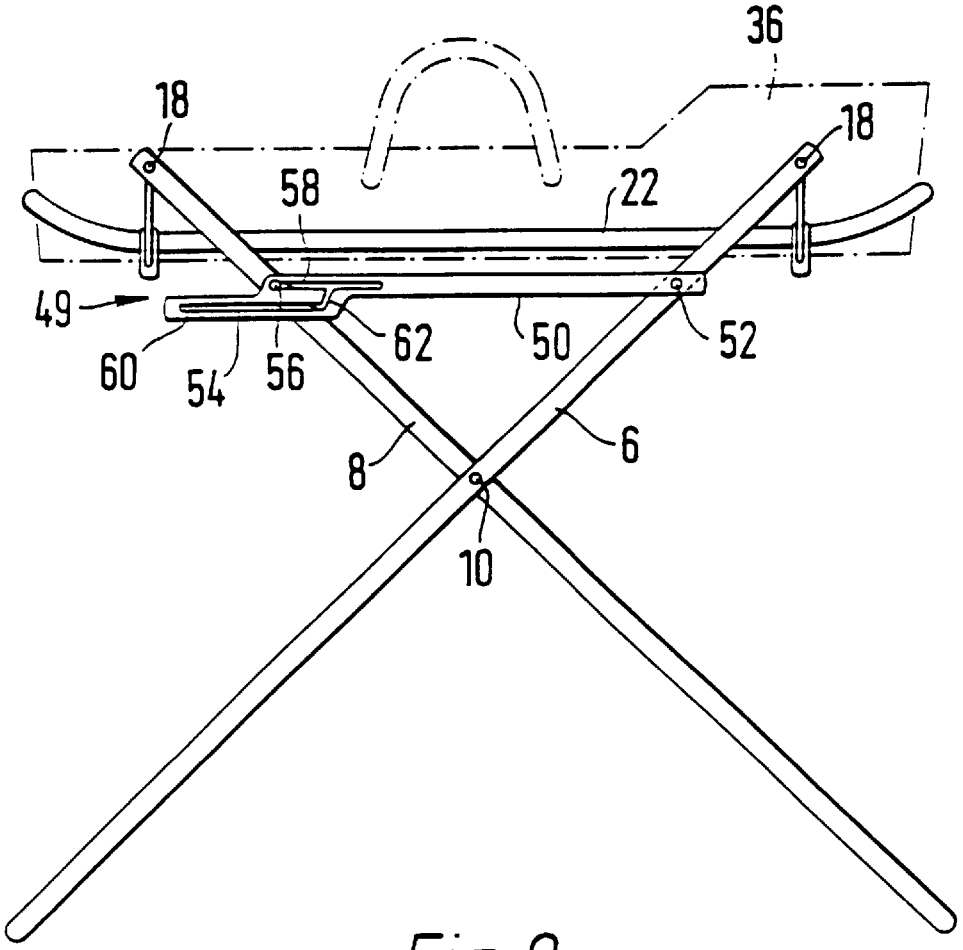
FIG. 9 is a side elevation of a second embodiment of a stand according to the invention in an erected configuration.

In the arrangement shown in FIG. 9 each scissor action side frame is provided with securing means 49 comprising a strut 50 which is pivoted to one limb 6 by a pivot pin 52 and has a trackway 54 at its other end which is slidingly engaged by a slider 56 projecting from the limb 8. The trackway includes upper 58 and lower 60 substantially horizontally disposed track sections interconnected by a short vertical cross-track section 62. The track sections are juxtaposed in a U-shape with the lower track section 60 extending further from pivot pin 52 than the upper track section 58. In use, tension in the strut 50 urges the slider 56 towards the end of the upper track section 58 furthest from the cross-track section 62.

Figure 9A:
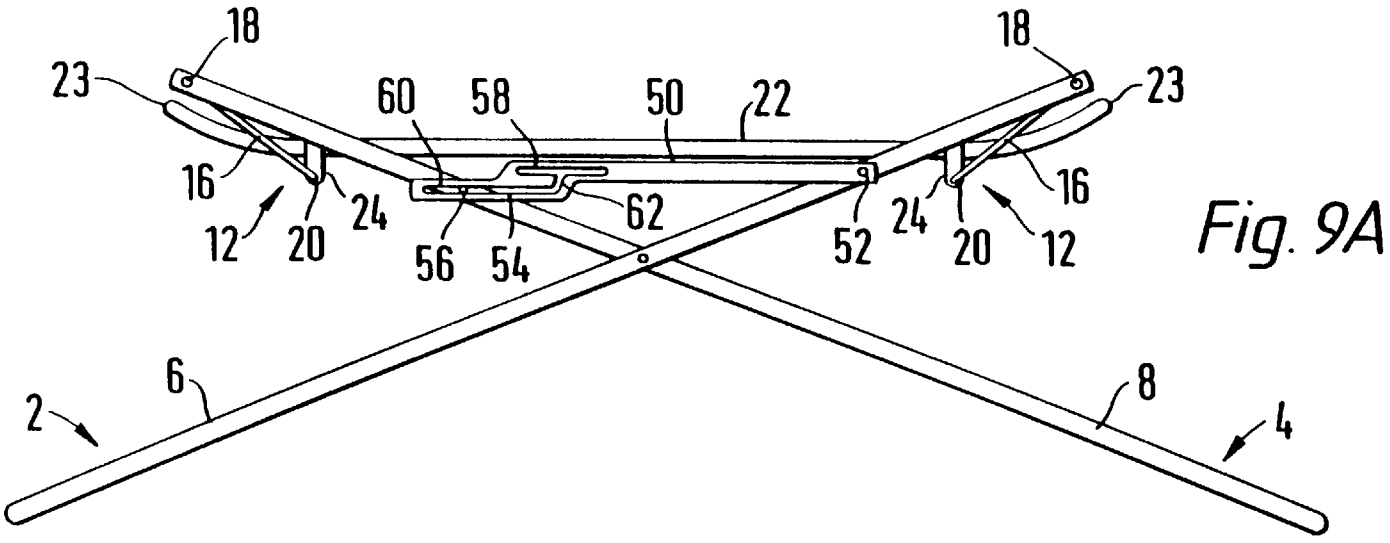
FIG. 9A is a side elevation of the stand shown in FIG. 9 in the process of being collapsed.

When there is a requirement to collapse the stand, the carry-cot 36 is lifted out of the frame 22 and the stand is raised slightly by lifting central regions of the struts 50. Due to the weight of the portions of the stand below the bolts 10, the two upper parts of the limbs 6, 8 of each side frame rotate towards each other, and the slider 56 moves towards and eventually drops into the cross-track section 62. The stand is then lowered to the ground and further lowering of the struts 50 permits the end portions of the limbs of each side frame to move away from each other. As this occurs the slider moves along the lower track section 60 towards its distal end as shown in FIG. 9A. The length of this lower track section permits the stand to collapse into a substantially flat configuration. Rotation of the upper ends of the link members 12 away from each other about the link flat portions permits this collapsing to occur without any detaching of the support frame 22 being necessary.

In order to erect the stand, the support frame 22 can simply be lifted until the cross-track section 62 of the strut 50 drops over the slider 56. This allows the slider to enter the upper track section 58 along which the slider 56 passes as the stand is lowered onto the ground and the support frame released.

Figure 10:
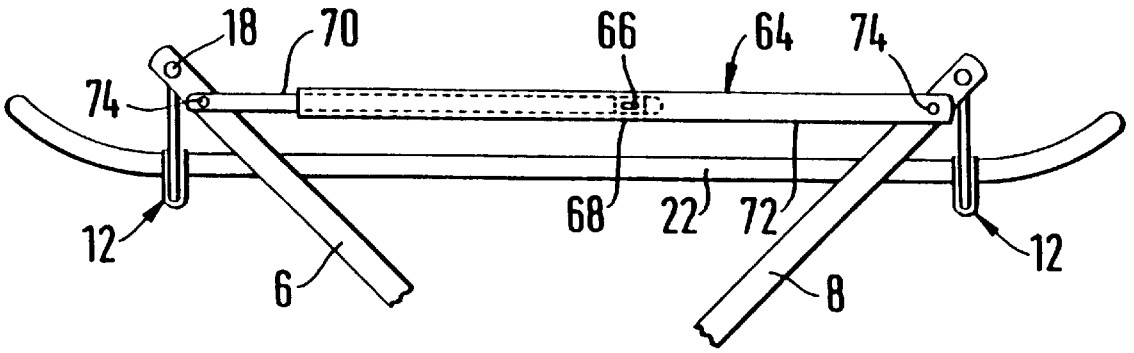
FIGS. 10, 11 and 12 are partial side elevations of three further embodiments of the invention employing alternative securing means.

A third embodiment is shown in FIG. 10 with a further alternative latch mechanism. In this embodiment a telescopic strut 64 is provided which includes an inner section 70 with an outwardly biased spring-loaded button 66 and an outer section 72 with a hole 68 through which the button 66 pops when the inner and outer sections 70, 72 have been telescoped together to a sufficient extent by erection of the stand. The distal end of each strut section is connected to an upper region of a stand limb 6, 8 by a pivot bolt 74. The lengths of the strut sections are such as to permit the stand to collapse to the configuration shown in FIG. 5 without becoming disengaged from each other.

Figure 11:
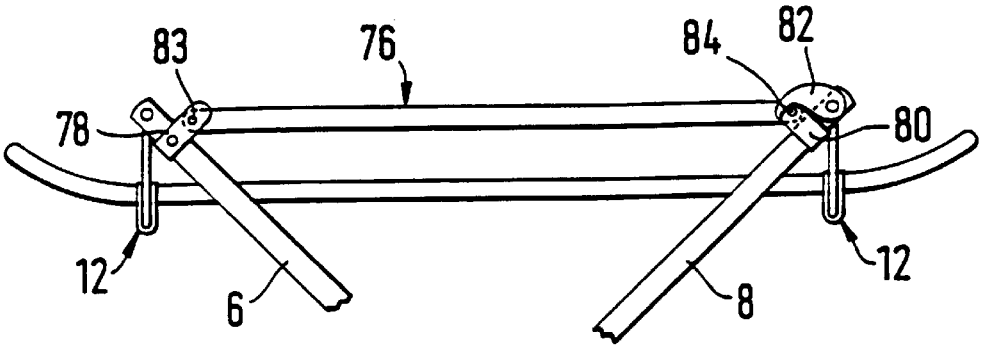

A fourth embodiment is shown in FIG. 11 which employs a latch mechanism on each side of the stand in which a sliding strut 76 is employed. One end of the sliding strut 76 is pivoted to a fixed bracket 78 secured near an upper end of one limb 6 and the other end is pivoted to a sliding bracket or carriage 80 which is held in the position shown in FIG. 11 by a spring-loaded detent or locking device 82 engaging a pin 84 on the sliding bracket. When there is a requirement to collapse the stand, the detent is released and the sliding bracket 80 slides down the upper portion of limb 8 towards the limb pivot bolt 10.

Figure 12:
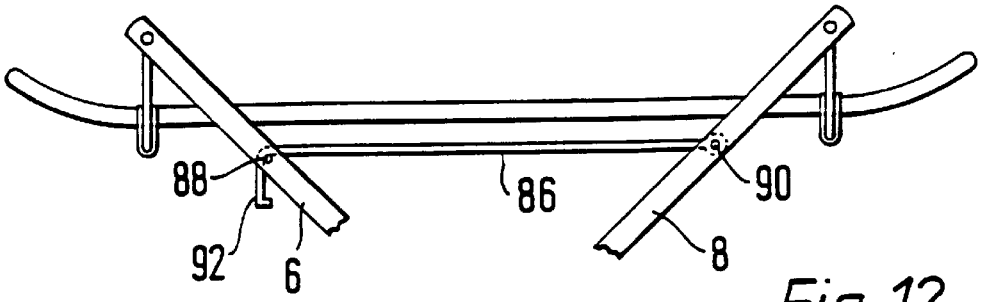
Figure 13:
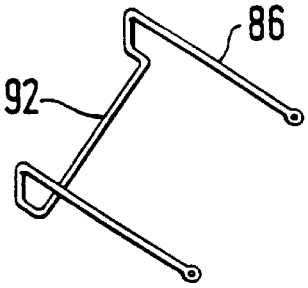
FIG. 13 is a perspective view of the securing strut shown in the embodiment of FIG. 12.

A fifth embodiment is shown in FIG. 12 in which the latch is constituted by a hooked strut 86, the shape of which is shown in the perspective view shown in FIG. 13. The strut 86 is pivoted to the side frame limbs 8 by pivots 90 and has a hooked end 92 for engagement with a cross-bar 88 which extends between the two side frames. When there is a requirement to collapse the stand, the hooked end 92 is disengaged from the cross-bar 88 and the stand is allowed to collapse.

Figure 14:
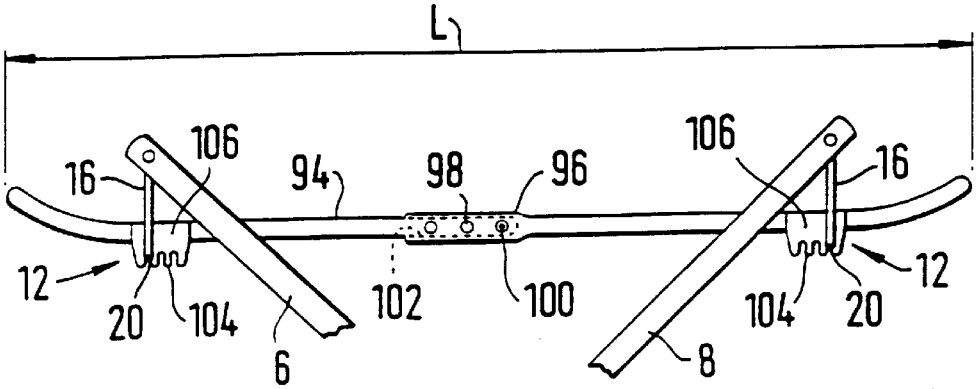
FIG. 14 is a partial side elevation of a further embodiment of the invention.

In the embodiment shown in FIG. 14, the stand has a telescopically adjustable support frame 94 comprising two interengageable parts which are U-shaped when viewed from above. The telescopic interengagement of the two parts is shown in FIG. 14. An outer section 96 has a series of holes 98 through one of which an outwardly spring-loaded button 100 mounted on an inner section 102 projects. The flat portion 20 of each link member 12 is snap-engaged in one of three slots 104 in a link securing clip 106 at each side of the telescopic frame 94. In FIG. 14, the telescopic frame is telescoped in to its minimum length (L). If there is a requirement for the length of the telescopic frame to be extended, for example if a longer carry-cot is to be accommodated, it will be necessary to locate the link members 12 in different slots 104 in the link securing clips 106 in order that the link upstand legs 16 can both depend vertically when the carry-cot is not swinging.

In the embodiment shown in FIGS. 10 to 14, the lower portions of the stand and the manner in which the stand components move relative to each other is the same as for the embodiments described above and have accordingly not been described in detail.

I claim:

1. Collapsible nursery stand comprising a pair of interconnected scissor action side frames each comprising a pair of limbs and securing means which in a first state secures the stand in an erected configuration and in a second state permits the stand to be collapsed, wherein the stand further comprises link means including at least two link members supported at respective pivot connections on the limbs and which depend from upper regions of the limbs when the stand is erected for swingingly supporting infant accommodating means and a structure attached to and interconnecting the link members at locations distal from the pivot connections which structure causes automatic rotation of the link members as the limbs of the side frames are pivoted relative to each other to collapse the stand.

2. The stand of claim 1 wherein the link means (12) depend substantially vertically when the stand is erected.

3. The stand of claim 1 wherein the link means (12) rotate through at least 45° as the stand collapses.

4. The stand of claim 1 wherein the upper regions of the limbs (6, 8) of each side frame move away from each other as the stand collapses.

5. The stand of claim 1 wherein the link means comprises two substantially U-shaped link members (12) each of which extends between the two side frames.

6. The stand of claim 5 further including spacer means (24, 46) for supporting the infant accommodating means (36) clear of a base portion (20) of each link member.

7. The stand of claim 1 wherein the structure comprises a frame (22).

8. The stand of claim 1 wherein the structure (22) has raised ends (23) for restraining movement of the infant accommodating means (36) relative to the structure (22).

9. The stand of claim 1 wherein the structure (94) is adjustable in length in order to cater for different sized infant accommodating means (36).

10. The stand of claim 9 including variable fixing means (104, 106) for permitting variation of the location at which at least one link (12) of the link means is securable to the structure (94).

11. The stand of claim 1 wherein each first and second limb (6, 8) of one side frame is connected to a first and second limb (6, 8) respectively of the other side frame by a cross-member (9).

12. The stand of claim 1 wherein the securing means (26, 49 . . . ) includes a separate securing means associated with each side frame.

13. The stand of claim 1 wherein the securing means comprises at least one over-centre latch mechanism (26).

14. The stand of claim 1 wherein the securing means comprises a strut (28, 50, 64, 76, 86) interconnecting the limbs (6, 8) of a side frame.

15. The stand of claim 14 wherein the strut (50, 64, 76) is connected to a first one of the limbs (6, 8) of one side frame by a pivot (52, 74, 83) and to a second one of the limbs (6, 8) of said one side frame by a sliding arrangement (54, 70, 80).

16. The stand of claim 15 wherein the strut (50, 64, 76) remains connected to both first and second limbs (6, 8) throughout collapsing of the stand (1).

17. The stand of claim 15 wherein the sliding arrangement comprises a slider (56) connected to the second limb (8) which slidingly engages a trackway (54) connected to the strut (50).

18. The stand of claim 17 wherein the trackway (54) includes substantially straight longer (60) and shorter (58) track sections interconnected by a cross-track section (62).

19. The stand of claim 15 wherein the sliding arrangement comprises a carriage (80) connected to the strut (76) which is displaceable along the second limb (8) and a locking device (82) for preventing such displacement when the stand is erected.

20. The stand of claim 14 wherein the strut (86) is connected to a first limb (8) of one side frame by a pivot (90) and is detachably securable to the second limb (6) of said one side frame.

21. The stand claim 14 wherein the strut (64) is adjustable in length.

* * * * *